United States Patent [19]

Langenfeld et al.

[11] Patent Number: 4,797,051

[45] Date of Patent: Jan. 10, 1989

[54] LOADER DEVICE FOR A TRACTOR

[75] Inventors: Joseph W. Langenfeld; Neal W. Westendorf, both of Onawa, Iowa

[73] Assignee: Westendorf Mfg. Co., Inc., Onawa, Iowa

[21] Appl. No.: 593,699

[22] Filed: Mar. 26, 1984

[51] Int. Cl.[4] ..... E02F 3/34

[52] U.S. Cl. ..... 414/686

[58] Field of Search ..... 414/686

[56] References Cited

U.S. PATENT DOCUMENTS

| | | | |
|---|---|---|---|
| 3,991,890 | 11/1976 | Frank | 414/686 |
| 4,033,469 | 7/1977 | Frank | 414/686 |
| 4,051,962 | 10/1977 | Westendorf | 414/686 |
| 4,217,075 | 8/1980 | Frank | 414/686 |
| 4,266,906 | 5/1981 | Langenfeld et al. | 414/686 |

FOREIGN PATENT DOCUMENTS

| | | | |
|---|---|---|---|
| 833368 | 2/1970 | Canada | 414/686 |
| 924679 | 4/1973 | Canada | 414/686 |
| 1248551 | 8/1967 | Fed. Rep. of Germany | 414/686 |
| 853758 | 11/1960 | United Kingdom | 414/686 |

*Primary Examiner*—Robert J. Spar

*Assistant Examiner*—Donald W. Underwood

*Attorney, Agent, or Firm*—Zarley, McKee, Thomte Voorhees & Sease

[57] ABSTRACT

A loader device is described comprising a bracket assembly mounted on the tractor adapted to removably receive a tower assembly having a pair of boom arms pivotally secured thereto. The bracket assembly includes a pair of horizontally disposed support members which are positioned substantially above and rearwardly of the front wheels of the tractor. A pivot pin is provided on the forward end of each of the support members. The tower assembly includes a pair of spaced-apart side frames having uprights mounted at the rearward ends thereof. The side frames pivotally engage the pivot pins during the mounting and dismounting operations to provide the necessary clearance between the loader and the front wheels of the tractor. The rearward ends of the side frames rest upon the upper ends of the support members when the loader is mounted on the tractor. The tower is mounted on the bracket assembly in such a way to prevent movement of the tower assembly relative to the bracket assembly during the time that the loader is being operated.

5 Claims, 5 Drawing Sheets

LOADER DEVICE FOR A TRACTOR

BACKGROUND OF THE INVENTION

Tractor loaders or front-end tractor loaders have long been used for a variety purposes. It is also well-known to provide a method and means for quickly mounting and dismounting the loaders from the tractors. A very successful loader is described in U.S. Pat. No. 3,324,954. Yet another loader device is described in U.S. Pat. No. 4,051,962. The loaders of the above-identified patents were designed for conventional tractors of the two-wheel drive type. The advent of four-wheel drive tractors has made it more difficult to mount the loaders thereon. The front wheels of the four-wheel drive tractors are much larger than the conventional two-wheel drive tractors and normally have much less clearance between the front wheels of the tractor and the tractor itself. Further, the sizes of the tractors have increased especially in the areas of the width of the front ends of the tractors.

It has therefore become difficult to provide the necessary clearance between the loader frames and the front wheels of the tractor since the conventional loaders normally include a subframe positioned between the front wheels of the tractor and the sides of the front end of the tractor. Further, the wide front ends of the tractor make it difficult to mount the loader on the tractor without scraping or damaging the sides of the tractor during the mounting and dismounting operations.

Therefore, it is a principal object of the invention to provide a loader device for a four-wheel drive tractor.

A further object of the invention is to provide a loader device for a tractor wherein the tower assembly of the loader is mounted on the tractor in such a manner so as not to interfere with the turning or pivoting of the front wheels of the tractor.

A further object of the invention is to provide a tractor loader including means thereon for preventing the loader from engaging the sides of the tractor as the loader is being mounted and dismounted.

A further object of the invention is to provide a tractor loader which eliminates the need for a front mounting bracket in many cases.

Still another object of the invention is to provide a tractor loader for a front-wheel drive tractor wherein the mounting pivot point is located substantially above and rearwardly of the front wheels of the tractor.

Still another object of the invention is to provide a loader device for a front-wheel drive tractor wherein the boom cylinders are positioned so as not to interfere with the turning or pivoting of the front wheels of the tractor.

Still another object of the invention is to provide a novel method and means for automatically mounting and dismounting a tractor loader without the need for extra stands.

Yet another object of the invention is to provide a loader device for a front wheel drive tractor which provides sufficient clearance for the front wheels while maintaining a low profile with respect to the tractor hood.

These and other objects will be apparent to those skilled in the art.

SUMMARY OF THE INVENTION

Figure 1:
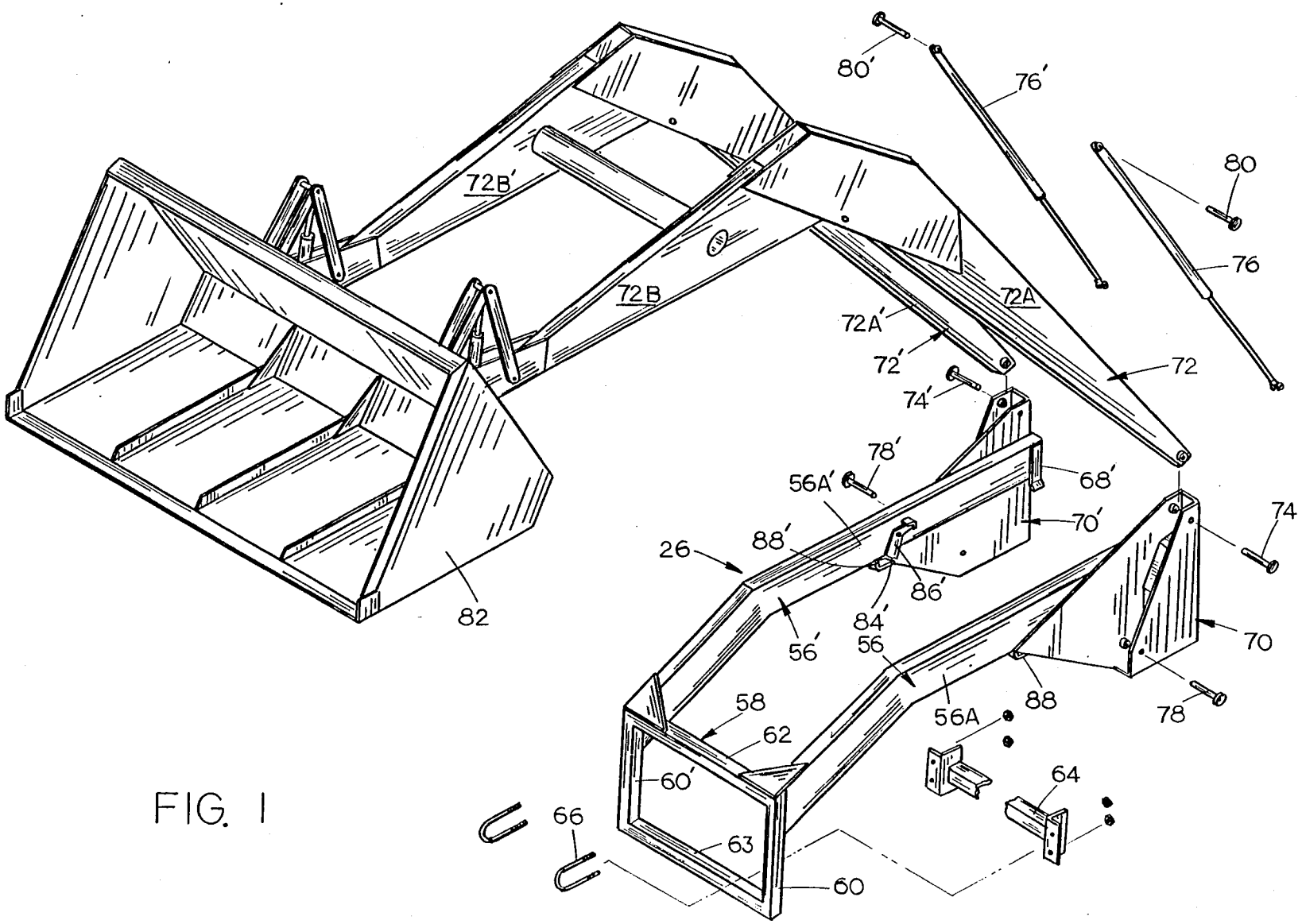
FIG. 1 is an exploded perspective view of a portion of the loader device of this invention.
Figure 2:
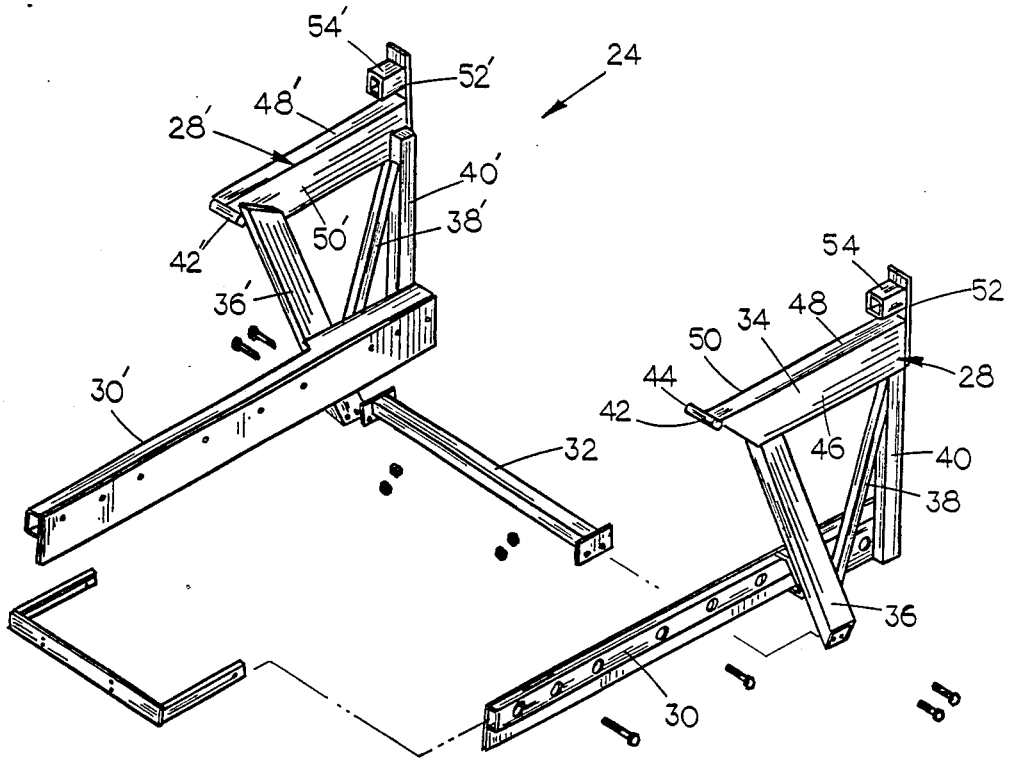
FIG. 2 is an exploded perspective view of the bracket assembly of this invention which is bolted to the tractor.
Figure 3:
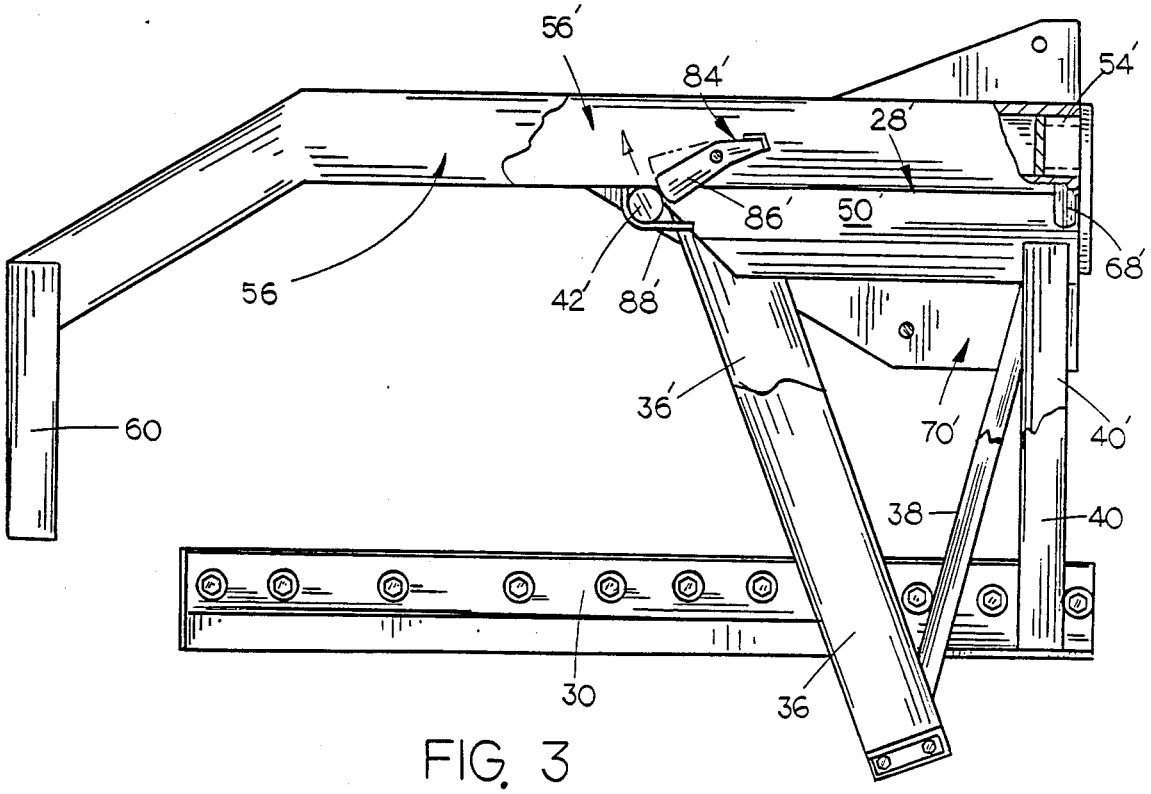
FIG. 3 is a side view of the tower assembly mounted on the bracket assembly with portions thereof cut away to more fully illustrate the invention.

A bracket means is secured to the tractor and is comprised of first and second bracket assemblies mounted on opposite sides of the tractor. Each of the bracket assemblies is provided with a horizontally disposed support member positioned substantially above and rearwardly of the front wheels of the tractor. A pivot pin is provided on the forward end of each of the support members. A tubular member is provided at the rearward end of each of the support members and is adapted to receive the rearward ends of the tower assemblies. A tower assembly is selectively mountable on the bracket means and comprises a pair of side frame members having uprights at the rearward ends thereof. A pivot plate is secured to each of the side frames at the rearward ends thereof and is adapted to pivot on the pivot pins during the mounting and dismounting operation. The rearward ends of the side frame members rest upon the upper ends of the support members when the loader is mounted on the tractor. Boom arms extend forwardly from the upper ends of the uprights and have an implement such as a bucket or the like mounted on the forward ends thereof.

DESCRIPTION OF THE PREFERRED EMBODIMENT

The loader device of this invention is referred to generally by the reference numberal 10 while the reference numberal 12 refers to a tractor of the four-wheel drive type including a pair of rear wheels 14 and a pair of front wheels 16. For purposes of description, tractor 12 will be described as having a front end 18 and a rearward end 20. As seen in the drawings, tractor 12 normally includes a weight bracket 22 at the forward end thereof.

Loader device 10 generally comprises a bracket means 24 which is secured to the tractor and remains on the tractor during times that the tower assembly 26 is dismounted from the tractor. Bracket means 24 comprises a pair of bracket assemblies 28 and 28' secured to the opposite sides of the tractor as illustrated in the drawings. Inasmuch as the bracket assemblies 28 and 28' are identical, only bracket assembly 28 will be described in detail with "'" indicating identical structure on bracket assembly 28'.

Bracket assembly 28 includes a horizontally extending bracket 30 which is bolted to the side of the tractor and which is interconnected to bracket assembly 28 by brace 32. Bracket assembly 28 includes a horizontally extending support member 34 spaced above bracket 30 as seen in the drawings and being supported thereby by tubular members 36, 38 and 40. Pivot pin 42 is secured to the forward end of support 34 and has an inwardly extending portion 44 extending inwardly from the inside surface of support member 34. For purposes of description, support member 34 will be described as including an outside surface 46, top surface 48 and inside surface 50. Plate 52 extends upwardly from the rearward end of support member 34 and has a tubular member 54 extending forwardly therefrom spaced above support member 34.

Tower assembly 26 comprises a pair of spaced-apart side frames 56 and 56' having a cross frame 58 secured to the forward ends thereof and extending therebetween. As seen in the drawings, cross frame 58 includes a pair of downwardly extending posts 60 and 60' having frame members 62 and 63 extending between the upper and lower ends thereof respectively. Bracket 64 is secured to frame member 63 by any convenient means such as U-bolts 66.

Pivot plates 68 and 68' extend downwardly from the inside surfaces of the rearward ends of the side frames 56 and 56' respectively. Uprights 70 and 70' are secured to the outer rearward ends of side frames 56 and 56' respectively. Boom arms 72 and 72' are pivotally secured at their rearward ends to the upper ends of the uprights 70 and 70' by means of pins 74 and 74'. Hydraulic cylinders 76 and 76' are pivotally connected at their rod ends to the lower forward ends of the uprights 70 and 70' by means of pins 78 and 78' and are pivotally connected at their base end to the boom arms 72 and 72' by means of pins 80 and 80'. As seen in the drawings, each of the boom arms 72 and 72'0 include a pair of arm sections 72A and 72B secured together so that the front sections 72B of the boom arms extend downwardly and forwardly from the rear arm sections 72A at approximately a 70° angle.

An implement such as a bucket 82 or the like is pivotally connected to the forward ends of the boom arms 72 and 72' in the manner described in our co-pending United States application, Ser. No. 525,150. The numerals 84 and 84' refer to locking assemblies including pivotal plates 86 and 86'. Locking assemblies 84 and 84' are described in U.S. Pat. No. 4,051,962.

Figure 4:
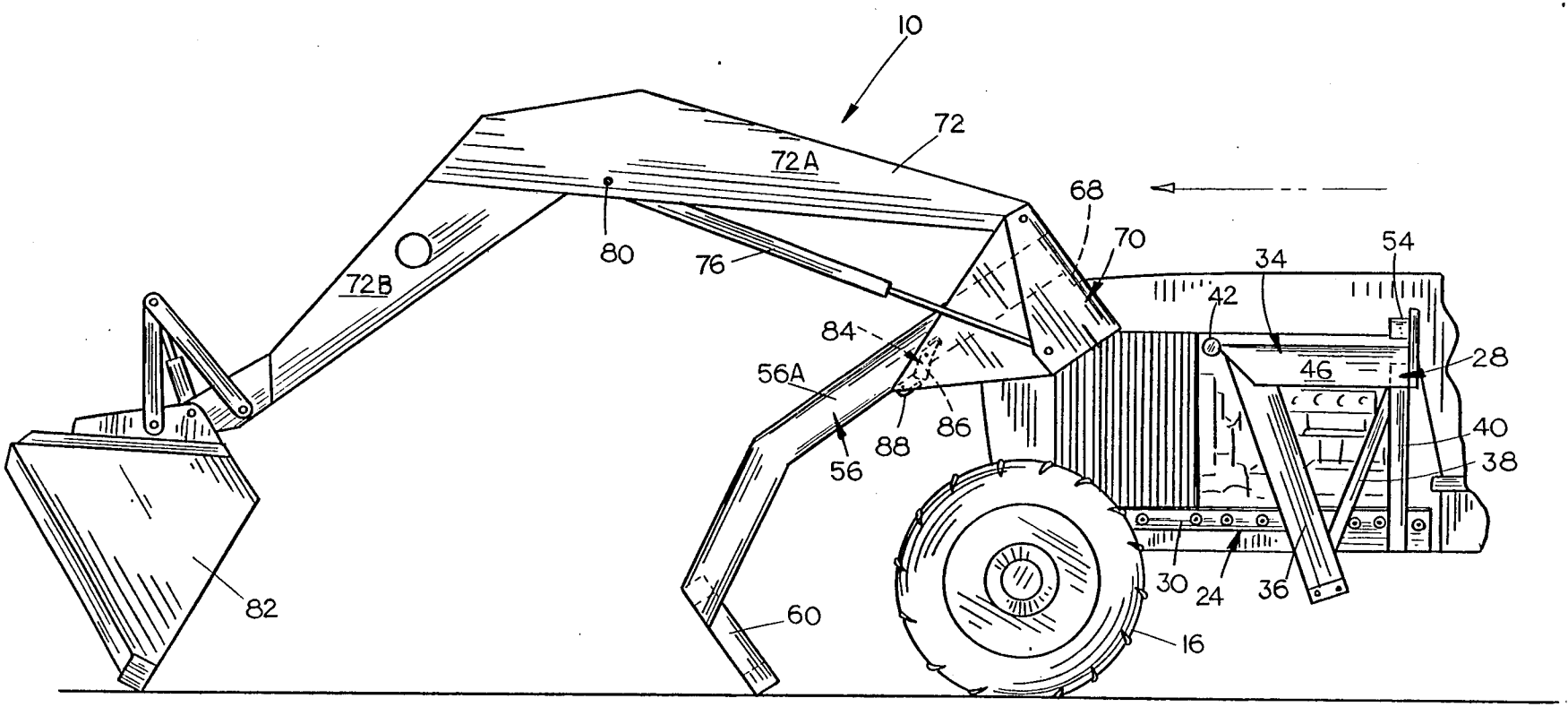
FIG. 4 is a side elevational view of the loader device of this invention illustrating the loader in a detached condition with respect to the tractor.
Figure 5:
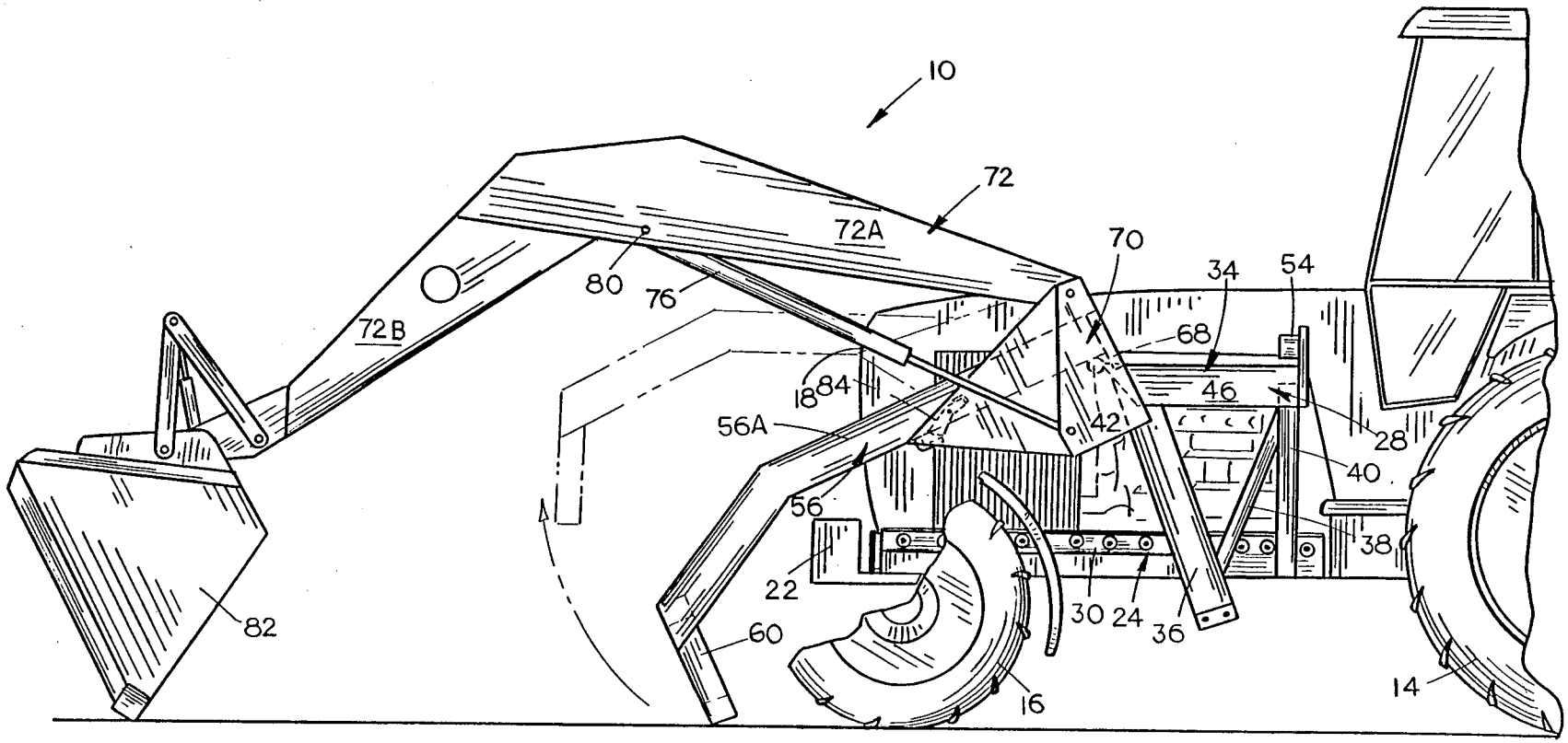
FIG. 5 is a view similar to FIG. 4 illustrating the loader being mounted on the tractor.
Figure 6:
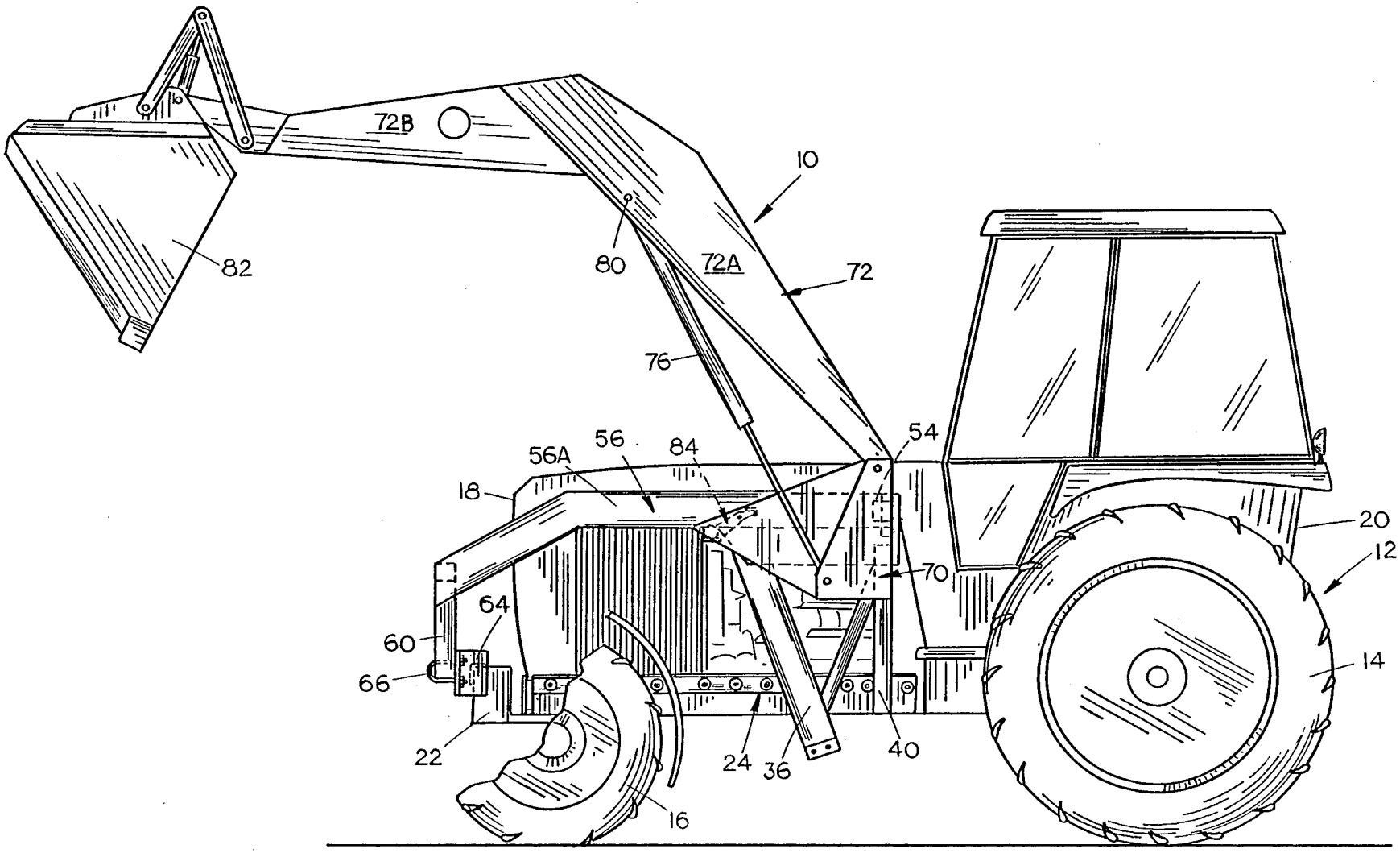
FIG. 6 is a view similar to FIGS. 4 and 5 except that the loader is illustrated as being mounted on the tractor.

Assuming that the bracket means 24 is mounted on the tractor and that the tower assembly 26 is dismounted from the tractor and positioned on the ground as illustrated in FIG. 4, the method of mounting the loader on the tractor is as follows. The forward end of the tractor is driven between the rearward ends of the side frames 56 and 56' until the lower rearward ends of the uprights 70 and 70' are positioned adjacent the upper surfaces of the forward ends of support members 34 and 34'. The hydraulic hoses from the tractor are connected to the hydraulic hoses on the loader and the hydraulic cylinders 76 and 76' are then retracted so that the side frames 56 and 56' and the uprights 70 and 70' are pivotally moved downwardly until the pivot plates 68 and 68' are positioned inwardly of the inside surfaces of the support members 34 and 34' rearwardly of the inwardly extending portions 44 and 44' of the pivot pins 42 and 42'. Continued retraction of the hydraulic cylinders 76 and 76' causes the forward ends of the side frames 56 and 56' to pivotally move upwardly from their ground engagement inasmuch as the pivot pins 42 and 42' prevent downwardly movement of the rearward ends of the side frames 56 and 56'. The hydraulic cylinders 76 and 76' are further retracted until the rearward portions 56A and 56A' of the side frames 56 and 56' are generally parallel to the upper surfaces 48 and 48' of the support members 34 and 34'. The tractor is then driven forwardly relative to the loader so that the rearward ends of the side frames 56 and 56' slide rearwardly on the top surfaces 48 and 48' of the support members 34 and 34' until the rearward ends of the side frames 56 and 56' are received by the tubular members 54 and 54' respectively. The engagement of the rearward ends of the side frames 56 and 56' with the tubular members 54 and 54' not only prevents further rearward movement of the side frames but also prevent upper vertical movement of the rearward ends of the side frames. The rearward ends of the side frames 56 and 56' rest upon the top surfaces 48 and 48' of the support members 34 and 34' so that the support members 34 and 34' support weight imposed therein from the side frames. The pivot plates 68 and 68' extend downwardly adjacent the inside surfaces of the rearward ends of the support members 34 and 34' and serve to prevent lateral movement of the side frames 56 and 56' when the loader is mounted on the tractor. The pivot plates 68 and 68' also function to prevent lateral movement of the side frames 56 and 56' during the mounting and dismounting operations. The fact that the outer forward ends of the support members 34 and 34' are positioned inwardly of the lower rearward ends of the uprights 70 and 70' during the mounting and dismounting operations also aids in preventing the uprights from striking or engaging the sides of the tractor.

Simultaneouly with the tubular members 54 and 54' receiving the rearward ends of the side frames 56 and 56', plates 86 and 86' pivot downwardly so that the forward ends thereof engage the rearward sides of the pivot pins 42 and 42' to maintain the pivot pins 42 and 42' in the angles 88 and 88'. The bracket 64 engages the weight bracket 22 to limit lateral movement of the forward portion of the tower assembly and also serves to impart downward vertical force to the weight bracket thereby relieving some of the stress imposed on the tower assembly.

It can therefore be seen that the pivot between the tower assembly and the bracket means mounted on the tractor is located substantially above and rearwardly of the front wheels of the tractor to provide the necessary clearance between the loader and the front wheels of the tractor during the mounting and dismounting operations. It can further be seen that the side frames of the tower assembly are positioned such that they will not interfere with the turning or pivotal movement of the front wheels of the tractor when the loader is mounted on the tractor. The location of the pivot point as described also prevents the hydraulic cylinders 76 and 76' from interfering with the turning or pivotal movement of the front wheels of the tractor.

The generally horizontally disposed support members 34 and 34' are very important for several reasons. When the loader is mounted on the tractor, the lower ends of the uprights 70 and 70' are positioned closely adjacent the outside surfaces of the support members 34 and 34' to aid in preventing lateral movement of the rearward end of the tower assembly when the tower assembly is mounted on the tractor. The horizontally disposed support members 34 and 34' also results in a stronger loader since the loader is more readily able to absorb side pressures created by the tractor during operation of the loader since the pressure is dissipated over the length of the support members 34 and 34'.

It is also highly desirable to locate the support members 34 and 34' below the upper end of the tractor hood as illustrated in the drawings so that the tractor operator is not faced with "tunnel" vision such as would occur if the support members 34 and 34' were located substantially above the upper end of the tractor hood. The location of the support members 34 and 34' are positioned directly forwardly of the tractor operator so that he can readily observe the relationship of the components during mounting and dismounting operations without leaving the tractor seat.

The loader is dismounted from the tractor in a manner opposite to that just described. Thus it can be seen that the loader device of this invention accomplishes at least all of its stated objectives.

We claim:

1. In combination, a tractor, a bracket means secured to the tractor, said bracket means including a first bracket assembly secured to said tractor at one side thereof, said bracket means also including a second bracket assembly secured to said tractor at the other side thereof, each of said first and second bracket assemblies comprising a longitudinally extending, generally flat horizontal support member at the upper end thereof; said support member having rearward and forward ends, and inner and outer sides, a pivot pin means on the forward end of each of said support members and extending inwardly therefrom, a first connector element at the rearward end of each of said support members, a tower assembly adapted to be releasably mounted on said bracket means, said tower assembly comprising a generally U-shaped frame means including spaced-apart first and second side frames having rearward and forward ends, and a front frame secured to the forward ends of said side frames and extending therebetween; a first upstanding upright secured to said first side frame and having upper and lower ends, inner and outer sides; a second upstanding upright secured to said second side frame and having upper and lower ends, inner and outer sides; the upper ends of said first and second uprights being positioned above said first and second side frames respectively, the lower ends of said first and second uprights being positioned below said first and second side frames respectively, first and second boom arms pivotally connected at their rearward ends to the upper ends of said first and second uprights respectively and extending forwardly therefrom; an implement pivotally secured to the forward ends of said boom arms; first power cylinder means connecting said uprights with said boom arms for raising and lowering said boom arms relative to said U-shaped frame means; second power cylinder means connecting said boom arms and said implement for pivotally moving said implement relative to said boom arms; first and second releasable connection means on said first and second side frames for connection to the inner ends of said pivot pin means on said support members for maintaining said frame means on said bracket means; the rearward ends of said first and second side frames adapted to be releasably connected to said connector elements at the rearward end of said support members for at least limiting the vertical movement of said side frames relative to said bracket means; the rearward ends of said side frames being supported upon said support members, the lower ends of said uprights being positioned below said support members, during and after the mounting of said tower assembly on said bracket means, the inner sides of said uprights being positioned outwardly of said support members during and after the mounting of said tower assembly on said bracket means, the relationship of said uprights to said support members, during the mounting of said tower assembly on said bracket means, serving to prevent the uprights from engaging the sides of the tractor, the relationship of said uprights to said support members, after the mounting of said tower assembly on said bracket means, serving to prevent lateral movement of the rearward end of said tower assembly relative to said bracket means.

2. The combination of claim 1 wherein said tractor is a four-wheel drive tractor having pairs of front and rear wheels, and wherein said support members are positioned between the front and rear wheels of said tractor, each of said support members being positioned substantially above the upper ends of said front wheels, said pivot pins being positioned substantially rearwardly and above the axles of said front wheels so that said side frames do not interfere with the turning movement of the front wheels of the tractor.

3. The combination of claim 2 wherein the lower ends of said uprights are positioned above the upper ends of said front wheels, said first power cylinder means being pivotally connected to the lower forward ends of said uprights.

4. The combination of claim 1 wherein said front frame embraces the forward end of said tractor to prevent lateral movement of said front frame relative to said tractor.

5. The combination of claim 1 wherein a pivot plate is secured to each of said side frames at the rearward ends thereof adapted to engage said pivot pins during mounting and demounting of the loader with respect to said tractor, said pivot plates being positioned adjacent the inner sides of said support members when the loader is mounted on the tractor.

* * * * *